US011441257B2

(12) United States Patent
Hato et al.

(10) Patent No.: US 11,441,257 B2
(45) Date of Patent: Sep. 13, 2022

(54) DRYER

(71) Applicant: Samsung Electronics Co., Ltd., Suwon-si (KR)

(72) Inventors: Shigenori Hato, Kanagawa (JP); Toshifumi Hashimoto, Kanagawa (JP); Hitoshi Minai, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 39 days.

(21) Appl. No.: 16/767,094

(22) PCT Filed: Nov. 23, 2018

(86) PCT No.: PCT/KR2018/014563
§ 371 (c)(1),
(2) Date: May 26, 2020

(87) PCT Pub. No.: WO2019/103544
PCT Pub. Date: May 31, 2019

(65) Prior Publication Data

US 2020/0378055 A1 Dec. 3, 2020

(30) Foreign Application Priority Data

Nov. 24, 2017 (JP) ..... JP2017-225387

(51) Int. Cl.
*D06F 58/22* (2006.01)

(52) U.S. Cl.
CPC ..... *D06F 58/22* (2013.01)

(58) Field of Classification Search
CPC ..... D06F 58/22; D06F 58/04
(Continued)

(56) References Cited

U.S. PATENT DOCUMENTS

| | | | | |
|---|---|---|---|---|
| 9,885,144 | B2 | 2/2018 | Cho et al. | |
| 10,077,528 | B2 | 9/2018 | Yoichi et al. | |
| 10,443,180 | B2 | 10/2019 | Lee et al. | |
| 2010/0223960 | A1* | 9/2010 | Kim | D06F 39/10 68/20 |

(Continued)

FOREIGN PATENT DOCUMENTS

| | | | |
|---|---|---|---|
| JP | 07039692 | A * | 2/1995 |
| JP | H11319380 | A | 11/1999 |

(Continued)

OTHER PUBLICATIONS

International Search Report dated Mar. 26, 2019 in connection with International Patent Application No. PCT/KR2018/014563, 2 pages.

(Continued)

*Primary Examiner* — Jessica Yuen

(57) ABSTRACT

The present disclosure relates to a clothes dryer capable of reducing pressure loss of air due to a lint removal device. The clothes dryer includes a case, a drum rotatably supported inside the case, an air supply port configured to guide air into the drum, an exhaust port configured to guide air inside the drum to the outside of the drum, an exhaust duct configured to guide air passed through the exhaust port to the air supply port, a connecting duct connecting the exhaust port and the exhaust duct, and a lint removal device configured to remove lint in the air passed through the exhaust port, wherein the lint removal device is disposed inside the exhaust duct and configured to communicate with the connecting duct.

13 Claims, 15 Drawing Sheets

(58) Field of Classification Search
USPC ..... 34/82
See application file for complete search history.

(56) References Cited

U.S. PATENT DOCUMENTS

| | | | | |
|---|---|---|---|---|
| 2014/0157621 | A1* | 6/2014 | Kim | D06F 58/50 34/480 |
| 2015/0252516 | A1* | 9/2015 | Cho | D06F 58/22 34/82 |
| 2016/0153136 | A1* | 6/2016 | Yoichi | D06F 58/22 34/82 |

FOREIGN PATENT DOCUMENTS

| | | | |
|---|---|---|---|
| JP | 2014-033841 | A | 2/2014 |
| JP | 2014068655 | A | 4/2014 |
| JP | 2014-101368 | A | 6/2014 |
| JP | 2016-043087 | A | 4/2016 |
| JP | 2016-101373 | A | 6/2016 |
| JP | 2016107025 | A | 6/2016 |
| KR | 10-2015-0105151 | A | 9/2015 |
| KR | 10-2016-0106265 | A | 9/2016 |

OTHER PUBLICATIONS

Written Opinion of the International Searching Authority dated Mar. 26, 2019 in connection with International Patent Application No. PCT/KR2018/014563, 9 pages.

Japan Patent Office, "Notice of Reasons for Refusal" dated Nov. 24, 2021, in connection with Japanese Patent Application No. 2017-225387, 7 pages.

* cited by examiner

DRYER

CROSS-REFERENCE TO RELATED APPLICATIONS

This application is a 371 of International Application No. PCT/KR2018/014563 filed on Nov. 23, 2018, which claims priority to Japanese Patent Application No. 2017-225387 filed on Nov. 24, 2017, the disclosures of which are herein incorporated by reference in their entirety.

FIELD

The present disclosure relates to a dryer for receiving and drying clothes in a rotating drum.

DESCRIPTION OF RELATED ART

In a process of operating a clothes dryer including a drum, lint (fluff) may be entrained in air discharged from the drum.

For example, in an air circulation type clothes dryer, air circulates through a heat exchanger, and thus lint entrained in the air needs to be removed before the air passes through the heat exchanger.

Patent document 1 discloses a lint removal device for capturing lint and a clothes dryer in which a heat exchanger is installed below a drum.

The lint removal device disclosed in patent document 1 includes a filter capable of capturing and separating lint, a lint transporter scraping lint remaining on a surface of the filter and pushing the lint from one side end of the filter, and a lint box disposed adjacent to the one side end of the filter to accumulate the lint pushed from the one side end of the filter.

The clothes dryer disclosed in patent document 1 includes a connecting duct installed to extend in the up-down direction and communicating with an exhaust duct, and the lint removal device is assembled to a portion constituting the connecting duct in a case.

Patent Document 1: Japanese Patent Publication No. 2014-101368

Recently, a clothes dryer having a small size and a large capacity is required. That is, a clothes dryer in which the overall size of a case is small, but the capacity of a drum is large is required. In particular, from the viewpoint of efficiently utilizing the installation space of a clothes dryer, a structure is required to reduce the size of the case in the front-rear direction and the left-right direction.

In the case of the clothes dryer disclosed in patent document 1, when the size of the case in the front-rear direction is reduced and the capacity of the drum is increased, an air flow path in the connecting duct is narrowed. For this reason, when the lint removal device is disposed on the connecting duct as in patent document 1, the pressure loss of air (here exhaust) by the lint removal device may increase.

SUMMARY

The present disclosure is directed to providing a clothes dryer capable of reducing pressure loss of air due to a lint removal device.

One aspect of the present disclosure provides a clothes dryer including a case, a drum rotatably supported inside the case, an air supply port configured to guide air into the drum, an exhaust port configured to guide air inside the drum to the outside of the drum, an exhaust duct configured to guide air passed through the exhaust port to the air supply port, a connecting duct connecting the exhaust port and the exhaust duct, and a lint removal device configured to remove lint in the air passed through the exhaust port, wherein the lint removal device is disposed inside the exhaust duct and configured to communicate with the connecting duct.

The lint removal device may include a frame member having at least one hole communicating with the connecting duct, a first filter mounted on the frame member to collect lint in the air passed through the exhaust port, and a lint transfer body configured to transfer the lint collected in the first filter to one side of the frame member.

The first filter may be detachably mounted to the frame member.

The connecting duct may be configured such that air passed through the exhaust port therefrom flows downward toward the exhaust duct, and the exhaust duct may be formed to be elongated in the front-rear direction such that air passed through the connecting duct therefrom flows from the front of the drum to the rear of the drum.

The exhaust duct may be disposed below the connecting duct.

The dryer may further include a heat exchanger disposed inside the exhaust duct and configured to exchange heat with air flowing in the exhaust duct, wherein the heat exchanger may be disposed downstream of the lint removal device along a direction in which the air flows in the exhaust duct.

The lint removal device may be disposed below an upper end of the heat exchanger.

The lint removal device may be detachably mounted to the exhaust duct.

The lint removal device may be disposed such that the first filter is spaced apart from a bottom surface of the case.

The dryer may further include a lint case receiving the lint removal device and detachably mounted to the case.

The lint case may be configured such that at least a portion thereof is disposed inside the exhaust duct when the lint case is mounted in the case.

The lint removal device may be detachably mounted to the lint case.

The lint case may include a second filter disposed in the rear of the first filter when the lint removal device is mounted.

The second filter may be disposed in the front of the heat exchanger in the exhaust duct.

The lint case may include a front wall portion and a support frame coupled to the rear of the front wall portion, and the support frame may include a lower wall portion extending rearward from an inner surface of the front wall portion and a filter support portion extending upward from an edge of the lower wall portion to support the second filter.

The lint case may be accommodated between the front wall portion and the filter support portion when the lint removal device is mounted.

The front wall portion may include at least one guide portion configured to guide the lint removal device when the lint removal device is mounted to the lint case, and the guide portion may protrude from the inner surface of the front wall portion.

A bottom surface of the case may include at least one support rib configured to support the lower wall portion when the lint case is mounted in the case.

The exhaust duct may include an accommodating space configured to accommodate the lint removal device, and a width of the accommodating space in the left-right direction of the case may be formed larger than a width of the connecting duct.

The dryer may further include a support frame having an entrance allowing clothes to be put in and out and coupled to an inner surface of the case, wherein the connecting duct may be formed in the support frame.

According to a clothes dryer of the present disclosure, because a lint removal device is disposed in an exhaust duct, pressure loss of air due to the lint removal device can be reduced, and maintenance and repair performance can be improved.

DETAILED DESCRIPTION

<First Embodiment>

Hereinafter, a first embodiment of the present disclosure will be described in detail with reference to the drawings. The following description is merely illustrative in nature and does not limit the present disclosure, its application, or its use. The directions of up, down, left, and right used in the description follow the arrows shown in FIG. 1.

(Overall Structure of Clothes Dryer)

Figure 1:
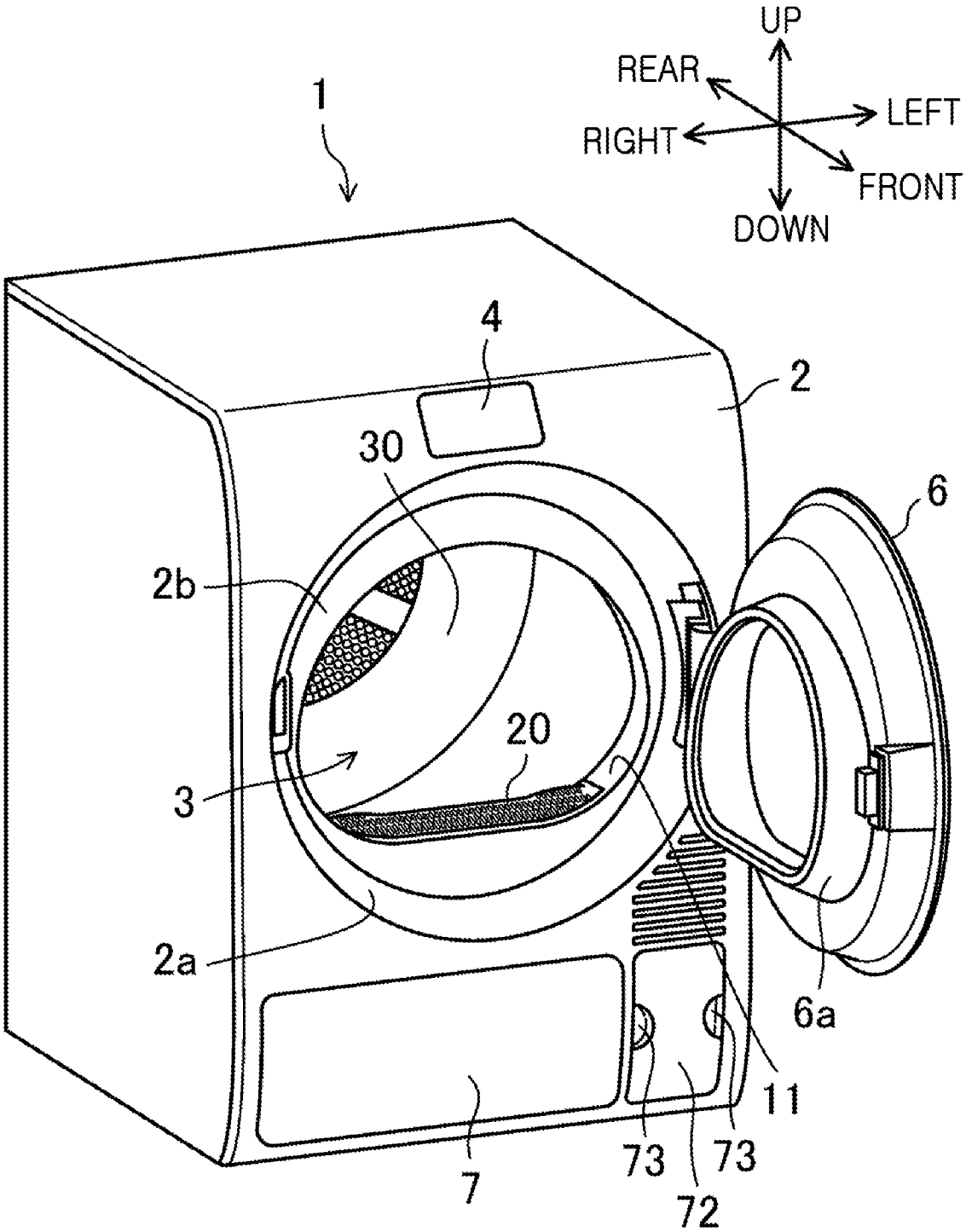
FIG. 1 is a schematic perspective view illustrating an outer appearance of a clothes dryer according to a first embodiment of the present disclosure in a state in which a door is opened.
Figure 2:
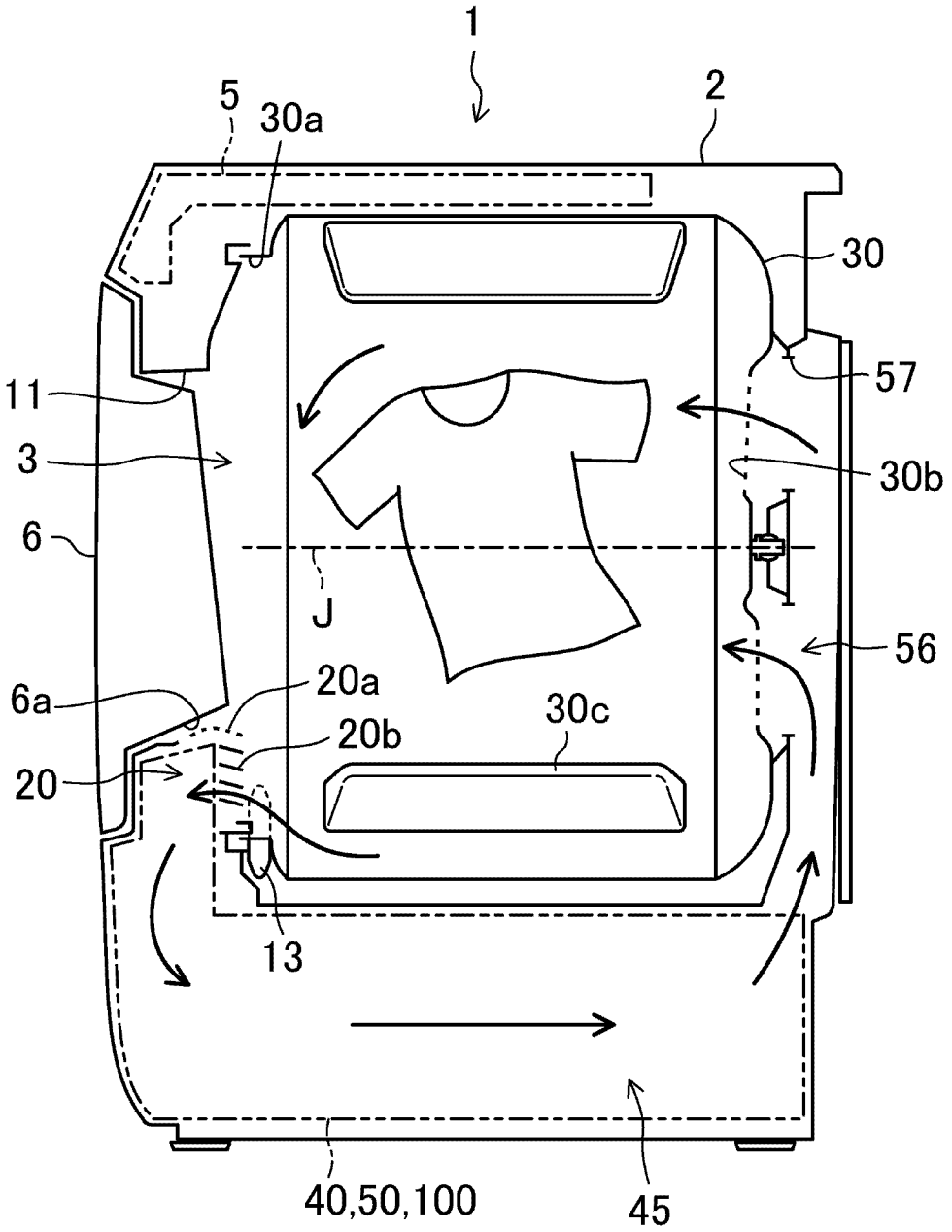
FIG. 2 is a schematic cross-sectional view illustrating an internal structure of the clothes dryer.

FIGS. 1 and 2 illustrate a clothes dryer 1 of a first embodiment of the present disclosure. The clothes dryer 1 is of air circulation type, generates dry air while circulating air, and dries clothes with the generated dry air.

The clothes dryer 1 includes a case 2 having a substantially rectangular parallelepiped shape, which is formed to be vertically elongated, and an entrance 3 for putting clothes in and out is formed at an upper portion of a front surface of the case 2.

The entrance 3 has a horseshoe-shaped appearance. Specifically, an upper portion of an edge of the entrance 3 is formed in an arc shape, and a lower end portion of the edge of the entrance 3 is formed in a chordal shape extending in a left-right width direction (approximately horizontal direction).

An operation portion 4 such as a touch panel is installed above the entrance 3. An electronic component 5 such as a substrate is installed in the rear of the operation portion 4 inside the case 2. A door 6 is coupled to the front surface of the case 2 through a hinge, and the entrance 3 is opened and closed by the door 6.

Figure 5:
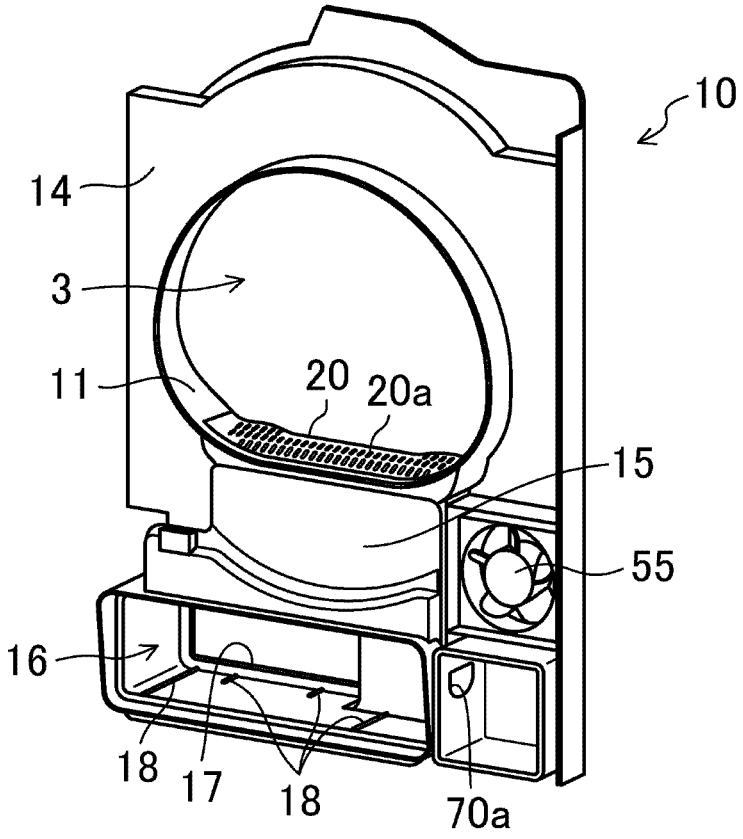
FIG. 5 is a schematic perspective view of a wall unit viewed from a front side.
Figure 6:
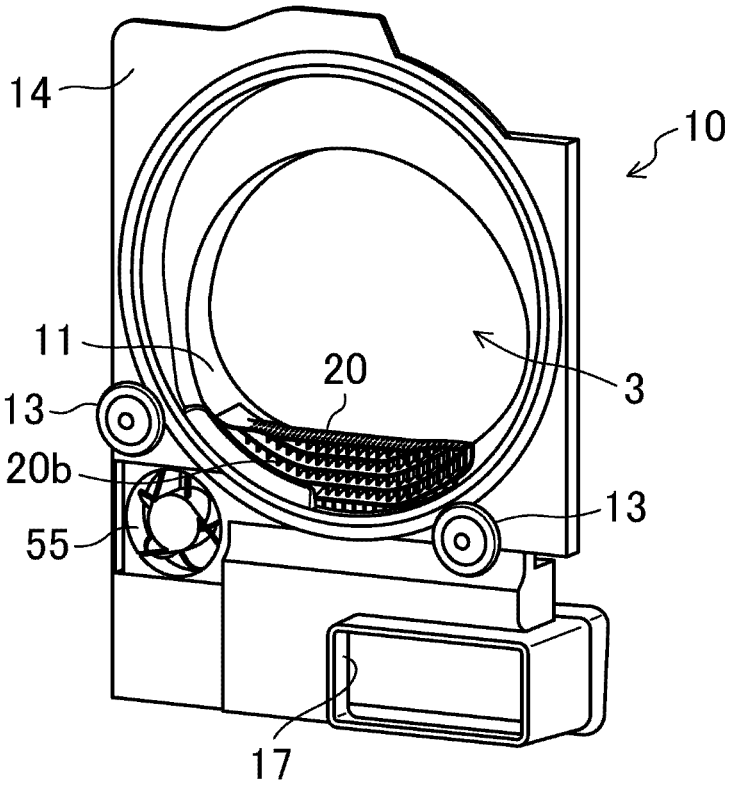
FIG. 6 is a schematic perspective view of the wall unit viewed from the rear side.

A wall unit 10 is integrally assembled inside the front surface of the case 2 (see FIGS. 5 and 6). As the wall unit 10 is assembled, an annular concave portion 2*a* recessed in an annular shape, an outer flange portion 2*b* protruding from an inner edge of the annular concave portion 2*a* to partition the entrance 3, a cylindrical inner flange portion 11 protruding from an inner edge of the outer flange portion 2*b* toward the inside of the case 2, and the like are formed at a front portion of the case 2.

A door protrusion portion 6*a* to be fitted to the annular concave portion 2*a*, the outer flange portion 2*b*, and the inner flange portion 11 is provided on the entrance 3 side of the door 6. An exhaust port 20 is provided at a lower end portion of the inner flange portion 11.

(Drum)

A drum 30 for receiving clothes is installed inside the case 2.

The drum 30 is provided in a cylindrical shape, and an opening 30*a* for putting clothes in and out is formed at a front end of the drum 30.

The drum 30 is arranged such that the opening 30*a* faces the entrance 3, and is supported on the case 2 in a rotatable state around a horizontal axis J extending in the front-rear direction.

Specifically, a central portion of a rear end of the drum 30 is pivoted on a rear portion of the case 2, and a circumferential edge portion of a front end of the drum 30 is supported on a plurality of guide rollers 13 installed on the front portion of the case 2.

Figure 3:
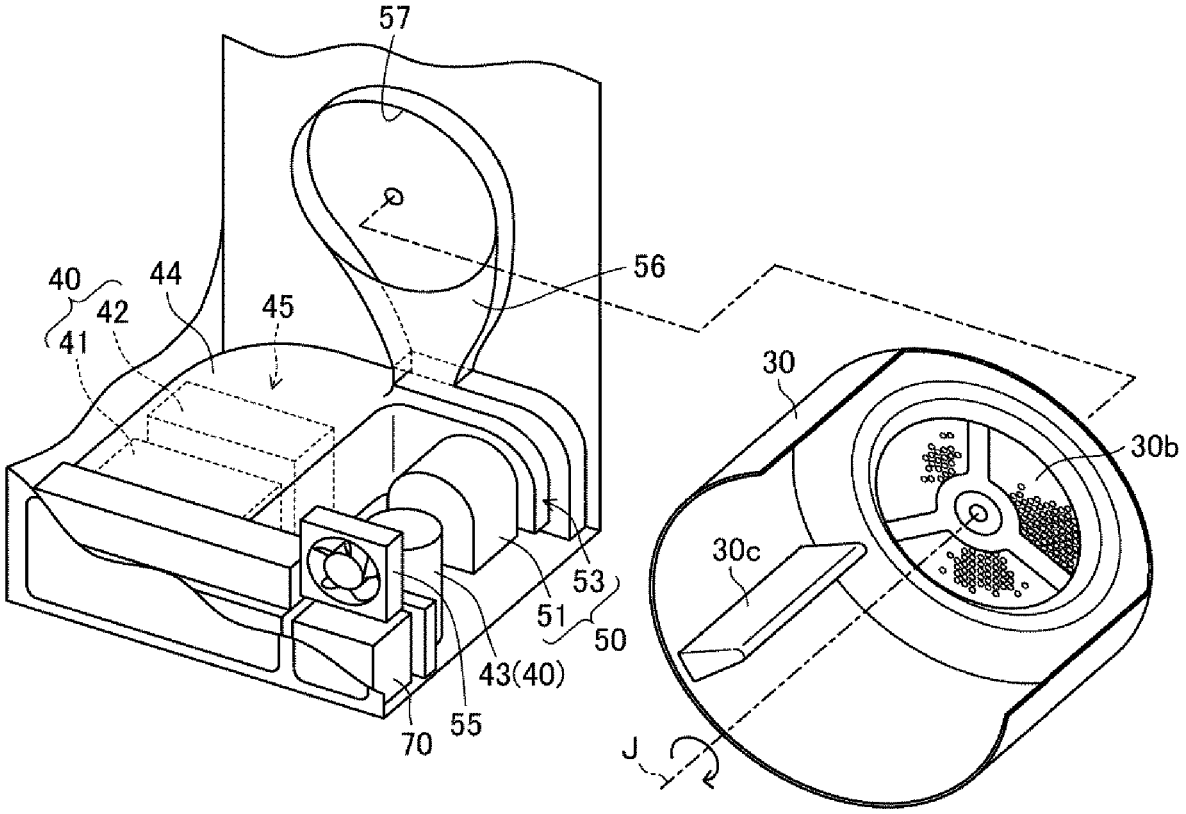
FIG. 3 is a schematic perspective view illustrating main devices of the clothes dryer.

As illustrated in FIG. 3, a circular vent hole 30*b* covered with a mesh filter is formed at the rear end of the drum 30.

A stirring plate 30*c* is attached to the inner surface of the drum 30. During a drying operation, the drum 30 is rotationally driven by a drive motor which is not shown.

(Configuration Devices)

Figure 4:
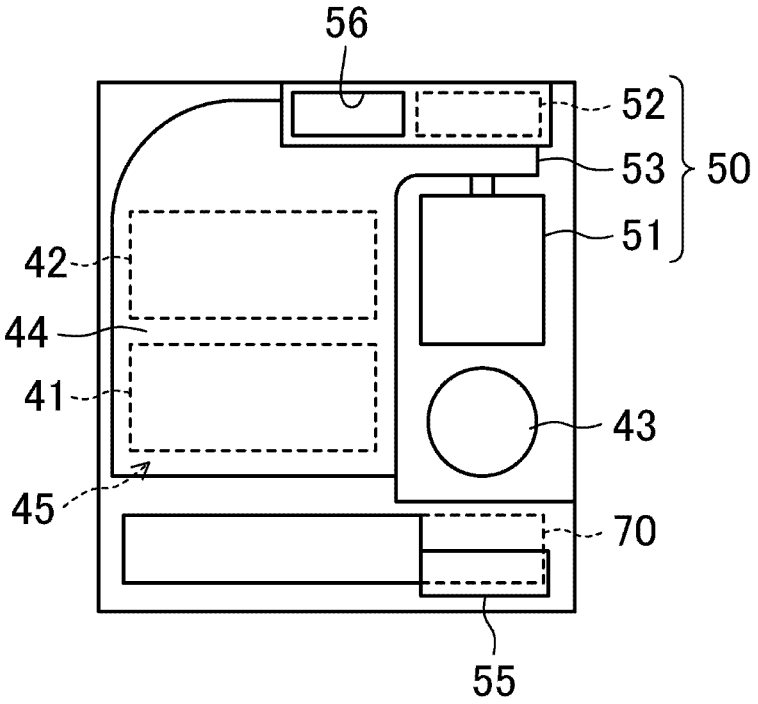
FIG. 4 is a schematic plan view illustrating an arrangement of the main devices of the clothes dryer.

As illustrated in detail in FIGS. 3 and 4, main devices constituting the clothes dryer 1, such as a heat exchanger 40, a blowing device 50, a lint removal device 100, and a lint box 70, are disposed at a lower portion of the clothes dryer 1.

As these devices are disposed at the lower portion of the clothes dryer 1, a sufficient installation space may be secured, and devices of large size and high performance may be selected. In addition, because the center of gravity is lowered, the clothes dryer 1 may be stably installed. Because these devices are positioned below the drum 30 that generates vibration during the drying operation, an effect capable of suppressing the vibration may also be obtained.

In addition, as will be described later, because a circulation path of air may be enlarged and simplified, reduction of pressure loss may be achieved by reducing air resistance, and air flowing out of the drum 30 may be smoothly guided to the heat exchanger 40.

In the first embodiment of the present disclosure, the lint removal device 100 is assembled to a lint case 60, which will be described later, and disposed on a front side of the lower portion of the clothes dryer 1. The lint removal device 100 is disposed in an exhaust duct 45 through which air discharged from the drum 30 flows.

(Wall Unit)

FIGS. 5 and 6 illustrate the wall unit 10 coupled to an inner side of the front surface of the case 2 and forming a portion of the case 2.

The wall unit 10 includes a support frame 14 attached to the inner side of the front surface of the case 2, and the support frame 14 is provided with an outside air introduction fan 55 and the exhaust port 20. The guide roller 13 is pivoted on an inner surface of the support frame 14.

The inner flange portion 11 is constituted by the support frame 14, and a connecting duct 15 is formed below the inner flange portion 11.

The connecting duct 15 extends downward from the exhaust port 20 in the up-down direction and is a flow path connecting the exhaust port 20 and the exhaust duct 45. The connecting duct 15 has a transverse width larger than a longitudinal width and extends in the up-down direction, and a lower end of the connecting duct 15 communicates with the exhaust duct 45.

A box-shaped space 16 extending in the left-right and horizontal directions and constituting a portion of the exhaust duct 45 is formed below the connecting duct 15. The lint removal device 100 and the lint case 60, which will be described later, are installed in the box-shaped space 16.

A transversely elongated rectangular shaped opening is provided in the box-shaped space 16. The opening is integrally connected with an opening (an air inlet 17) of a front surface of the exhaust duct 45.

The lint box 70 is disposed on the left side of the box-shaped space 16.

The outside air introduction fan 55 is disposed above the lint box 70.

(Exhaust Port)

The exhaust port 20 is composed of a plurality of fins and the like, and provided at the lower end portion of the inner flange portion 11.

An inner side of an upper portion of the connecting duct 15 is constituted by an exhaust port 20. An upper portion 20*a* of the exhaust port 20 is formed in a transversely elongated rectangular shape. An inner portion 20*b* of the exhaust port 20 is formed in an arc shape and disposed to face a lower end portion of the opening 30*a* of the drum 30 in the front-rear direction.

The center of the exhaust port 20 in a width direction is positioned below the center of the drum 30. Therefore, the exhaust port 20 is not affected by the rotating drum 30 and may allow air to be stably discharged without bias.

As illustrated in FIG. 2, when the door 6 is closed, the upper portion 20*a* of the exhaust port 20 faces the door protrusion portion 6*a* of the door 6 in the up-down direction with a gap interposed therebetween, and the inner portion 20*b* of the exhaust port 20 faces the inside of the drum 30. That is, the exhaust port 20 communicates with a front portion of the drum 30 in the state where the door 6 is closed.

The air in the drum 30 during the drying operation is mainly guided to the connecting duct 15 through the inner portion 20*b* of the exhaust port 20 and flows downward.

(Exhaust Duct)

The exhaust duct 45 extends in a direction intersecting a direction (the up-down direction) in which the connecting duct 15 extends, as illustrated in FIG. 2. Specifically, the exhaust duct 45 communicates with the lower end of the connecting duct 15 and extends toward a rear side.

The exhaust duct 45, together with the connecting duct 15, forms a substantially L-shaped flow path when viewed in the left-right direction.

The above-described box-shaped space 16 is positioned in a portion of the exhaust duct 45 that communicates with the connecting duct 15. In the following description, the portion of the exhaust duct 45 communicating with the connecting duct 15 is defined as the box-shaped space 16.

The exhaust duct 45 is formed by coupling a duct cover 44 to a bottom surface 2*c* of the case 2.

The box-shaped space 16 is constituted by a portion of the bottom surface 2*c* of the case 2, and a portion of the exhaust duct 45 formed by a bottom surface of the wall unit 10 has the transverse width larger than the longitudinal width and extends in the up-down direction.

A flow path cross-sectional area of the exhaust duct 45 is provided larger than a flow path cross-sectional area of the connecting duct 15, and the portion of the exhaust duct 45 communicating with the connecting duct 15, that is, the box-shaped space 16 is provided as an area having the largest flow path cross-sectional area. That is, a width of the box-shaped space 16 in the left-right direction of the case 2 may be formed larger than a width of the connecting duct 15.

(Heat Exchanger)

The heat exchanger 40 is composed of an evaporator 41, a condenser 42, a compressor 43, and the like.

The evaporator 41 and the condenser 42 both have an outer appearance of a rectangular parallelepiped shape with the transverse width larger than the longitudinal width and are accommodated and arranged in the duct cover 44 side by side in the front-rear direction. That is, the heat exchanger 40 is disposed in the exhaust duct 45.

The heat exchanger 40 is disposed further downstream than the lint removal device 100 along a direction (see the arrows in FIG. 2) in which air flows inside the exhaust duct 45.

Because a space formed immediately below the drum 30 is narrow compared to a space formed on opposite lower sides of the drum 30, the evaporator 41 or the like having a large volume is disposed on one side of the lower portion of the drum 30. Therefore, during the drying operation, the air flowing out from the exhaust port 20 is introduced into the heat exchanger 40 from a front side of the evaporator 41, cooled and dehumidified in the evaporator 41, reheated in the condenser 42, and then discharged from the heat exchanger 40 in a dry state.

The compressor 43 is disposed on the left side of the duct cover 44.

In addition to the above-described components, the heat exchanger 40 is further provided with a valve, a pipe, and the like which are not shown.

(Blowing Device)

The blowing device 50 is composed of a motor 51, a blowing fan 52, a fan cover 53, and the like, and as illustrated in FIGS. 3 and 4, the blowing device 50 is disposed further downstream than the heat exchanger 40 along the direction (see the arrows in FIG. 2) in which air flows inside the exhaust duct 45.

The outside air introduction fan 55 for introducing outside air into the case 2 is disposed in the front of the compressor 43. The outside air introduction fan 55 is coupled to the wall unit 10.

The blowing fan 52 is, for example, a centrifugal fan, and is covered by a fan cover 53. The fan cover 53 is provided with a suction port and a discharge port, and the suction port is connected to a rear end (downstream side) of the exhaust duct 45.

As illustrated in FIG. 3, an air supply duct 56 is provided along an inner surface of a rear wall of the case 2.

The discharge port of the fan cover 53 is connected to one end of the air supply duct 56.

A circular air supply port 57 is formed at the other end of the air supply duct 56. As the air supply port 57 faces the vent hole 30*b* of the drum 30, the air supply duct 56 communicates with a rear portion of the drum 30 through the air supply port 57 and the vent hole 30*b*.

During the drying operation, the blowing fan 52 is rotated by driving the motor 51 and generates a flow of air from the exhaust port 20 toward the air supply port 57. Accordingly, a circulation of air passing through the drum 30 is formed (see the arrows in FIG. 2). By the blowing fan 52 and the heat exchanger 40, humid air flows out of the drum 30 through the opening 30*a* and the exhaust port 20, and dry air is introduced into the drum 30 through the air supply port 57 and the vent hole 30*b*.

(Lint Removal Device)

The lint removal device 100 is a device for removing lint in air flowing out from the exhaust port 20.

Figure 7:
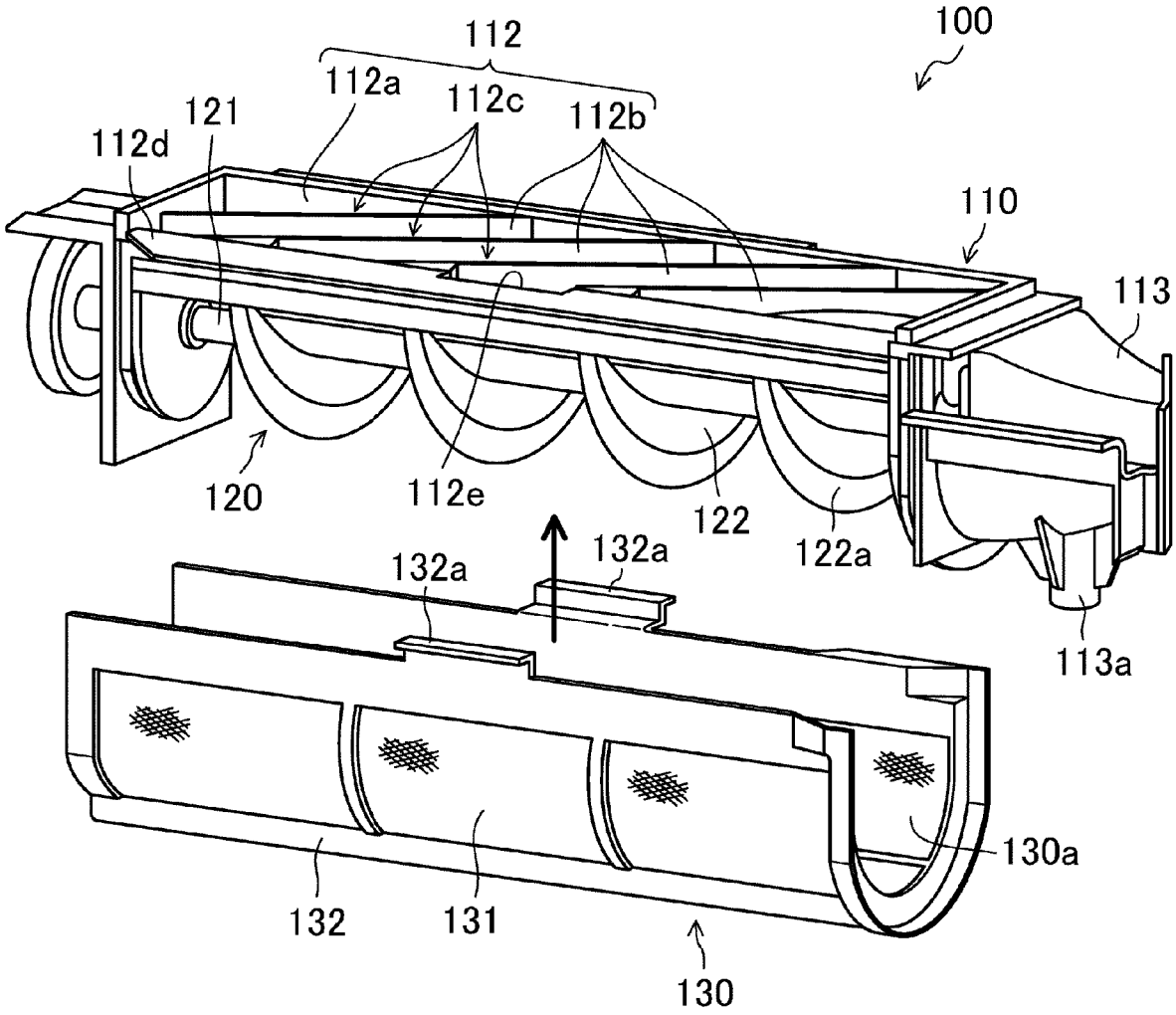
FIG. 7 is a schematic perspective view of a lint removal device.
Figure 8:
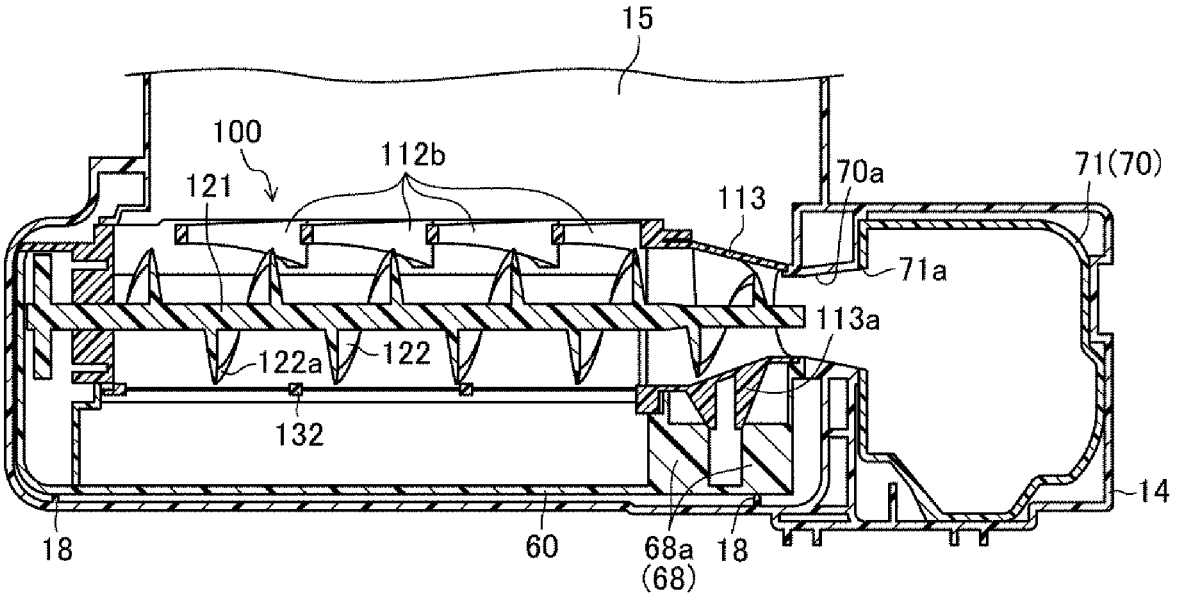
FIG. 8 is a schematic cross-sectional view of the lint removal device.

The lint removal device 100 is shown in detail in FIGS. 7 and 8. The lint removal device 100 is composed of a frame member 110, a screw 120 (lint transport member), a lint filter 130 (first filter), and the like.

The screw 120 includes a rotating shaft 121 and a helical fin 122 provided on the rotating shaft 121. The fin 122 may be composed of a plurality of the fins 122 spaced apart from each other along an axial direction of the rotating shaft 121, and outer diameters of the plurality of fins 122 may all be designed to be the same.

A drive device (not shown) such as a motor is coupled to one end of the screw 120 to generate power for rotating the screw 120.

The frame member 110 is composed of a lint processing portion 112, a lint induction portion 113, and the like.

The lint processing portion 112 includes a rectangular shaped frame body 112*a*, and a plurality of lattices 112*b* extending obliquely to intersect respect to an axial center direction of the rotating shaft 121 of the screw 120, as illustrated in FIG. 7.

An air introduction port 112*c* is formed between the frame body 112*a* and the lattice 112*b* and between the lattices 112*b* adjacent to each other, and the air passed through the connecting duct 15 is introduced into the lint filter 130 from the air introduction port 112*c*.

Figure 12:
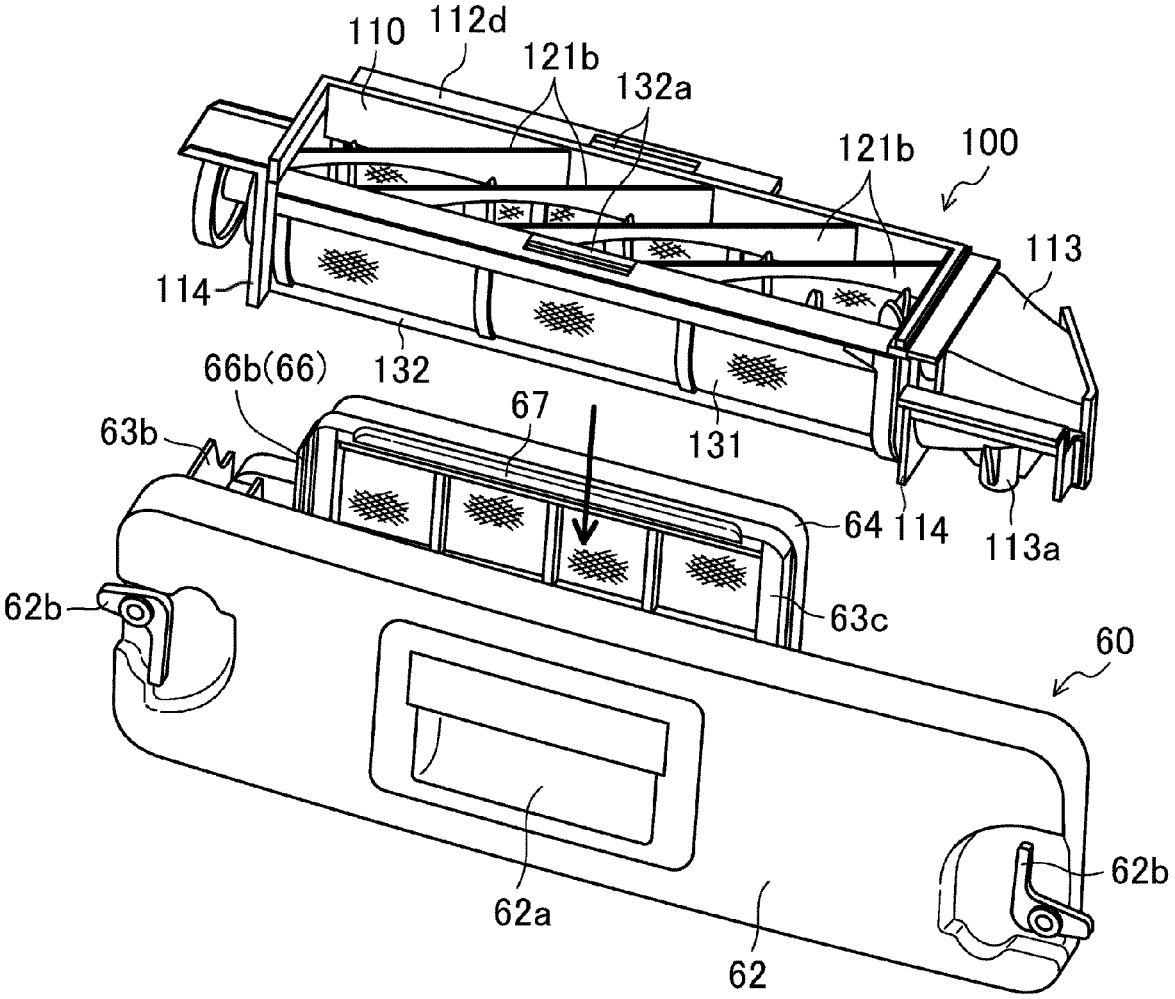
FIG. 12 is a perspective view illustrating a process of attaching the lint removal device to the lint case.

The lattice 112*b* includes a lower surface facing the lint filter 130, and as illustrated in FIGS. 8 and 12, the lower surface of the lattice 112*b* includes a curved surface recessed upward. This curved surface is formed in a shape corresponding to a portion of a rotational trajectory of the screw 120.

Two of protrusion portions 112*d* protruding toward the front side and the rear side are formed at a front side end and a rear side end of the frame body 112*a* of the lint processing portion 112, respectively. As will be described later, the protrusion portion 112*d* is a configuration for supporting the lint filter 130 and at the same time, is a configuration for supporting the lint removal device 100 in a state where the lint removal device 100 is coupled to the maintenance box 60.

The lint filter 130 having a U-shaped cross-section and elongated in the horizontal direction is detachably mounted to the lint processing portion 112.

The lint filter 130 is composed of a sheet-shaped mesh filter 131 having holes of a diameter that does not pass through lint, and a filter frame 132 having a U-shaped cross-section supporting the mesh filter 131 and elongated transversely.

The lint filter 130 is disposed such that an inner cross-section arc-shaped surface thereof (a collection surface 130*a*) faces an upstream side of the air flow path.

As illustrated in FIG. 8, an inner diameter of the collection surface 130*a* is set larger than an outer diameter of the fin 122 of the screw 120, and a rubber plate 122*a* (an elastic member) in contact with the collection surface 130*a* is attached to an outer edge of the fin 122.

As illustrated in FIG. 7, the lint filter 130 is provided detachably on the frame member 110.

The filter frame 132 is formed of a material having elasticity, and a projection portion 132*a* is provided at each of upper ends of opposite sides of the filter frame 132. A locking portion 112*e* corresponding to the projection portion 132*a* is formed on the protrusion portion 112*d* of the lint processing portion 112.

When the filter frame 132 is pushed from a lower side of the frame member 110 to cover the screw 120, the filter frame 132 is elastically deformed, so that each of the projection portions 132*a* is caught in each of the locking portions 112*e*. Accordingly, the lint filter 130 is mounted on the lint processing portion 112.

The lint removal device 100 does not operate during the drying operation of clothes and may be set to operate for a certain period of time when the drying operation of clothes is not performed (for example, when the blowing device 50 or the heat exchanger 40 does not operate after the operation of the clothes dryer 1 is finished or before the operation of the clothes dryer 1 starts).

During the drying operation, lint in the circulating air is captured in the lint filter 130 and is accumulated on the collection surface 130*a*. The lint filter 130 is designed in a size and shape in which clogging does not occur with the amount of lint generated during the drying operation of at least one time.

When the drying operation is finished, a lint mass in the form of a film is liable to be formed by lint remaining on the collection surface 130*a* (lint film). The lint film is scraped from the lint filter 130 by the screw 120 as the screw 120 rotates and is pushed out to the left side of the lint filter 130.

As long as the lint film may be scraped off, the rubber plate 122*a* may not be attached to the fin 122, and a gap may exist between the fin 122 and the collection surface 130*a*. In this case, protrusions (fluffy protrusions) in contact with the collection surface 130*a* to catch the lint film may be provided on a portion of a front end of the fin 122.

Because the lint removal device 100 does not work during the drying operation and may collectively remove lint, lint removal is possible in a short time. Therefore, complicated control and a high-functionality device are unnecessary, and device cost and running cost may be reduced.

The lint induction portion 113 is positioned adjacent to the left side of the lint processing portion 112 and formed in a bucket shape. The lint induction portion 113 receives the lint film pushed out from the lint filter 130 and guides the lint film to the lint box 70.

As illustrated in FIG. 8, the lint induction portion 113 is provided in a tapered shape whose cross-sectional area becomes smaller toward the lint box 70 side in the axial center direction of the rotating shaft 121. The lint induction portion 113 includes a protrusion portion 113*a* protruding downward from a lower surface thereof. As will be described later, the protrusion portion 113*a* supports the lint removal device 100 in a state in which the lint removal device 100 is attached to the maintenance box 60.

(Lint Box)

The lint box 70 is disposed on the left side of the lint induction portion 113 and stores the lint film scraped from the collection surface 130*a*.

As the lint box 70 is disposed adjacent to a left end of the lint filter 130, the lint film may be easily transferred to the lint box 70 even without a complicated transport mechanism.

The lint box 70 includes a receiving portion 71 for receiving the lint film, and a front wall portion 72 installed to cover a front side of the receiving portion 71 and attached to the case 2.

The receiving portion 71 of the lint box 70 and the lint induction portion 113 communicate with each other through a lint transfer port 70*a*, which is formed in a portion of an upper right side of the box-shaped space 16 of the case 2 (strictly the wall unit 10), and a lint receiving port 71*a* formed in a portion of an upper left side of the receiving portion 71. Therefore, the lint film pushed out from the lint filter 130 may be transferred into the receiving portion 71 of the lint box 70 as it is.

The lint box 70 of the clothes dryer 1 is composed of a separate member from the lint case 60 and detachably installed on a lower portion of the case 2 unlike the lint case 60.

Figure 9:
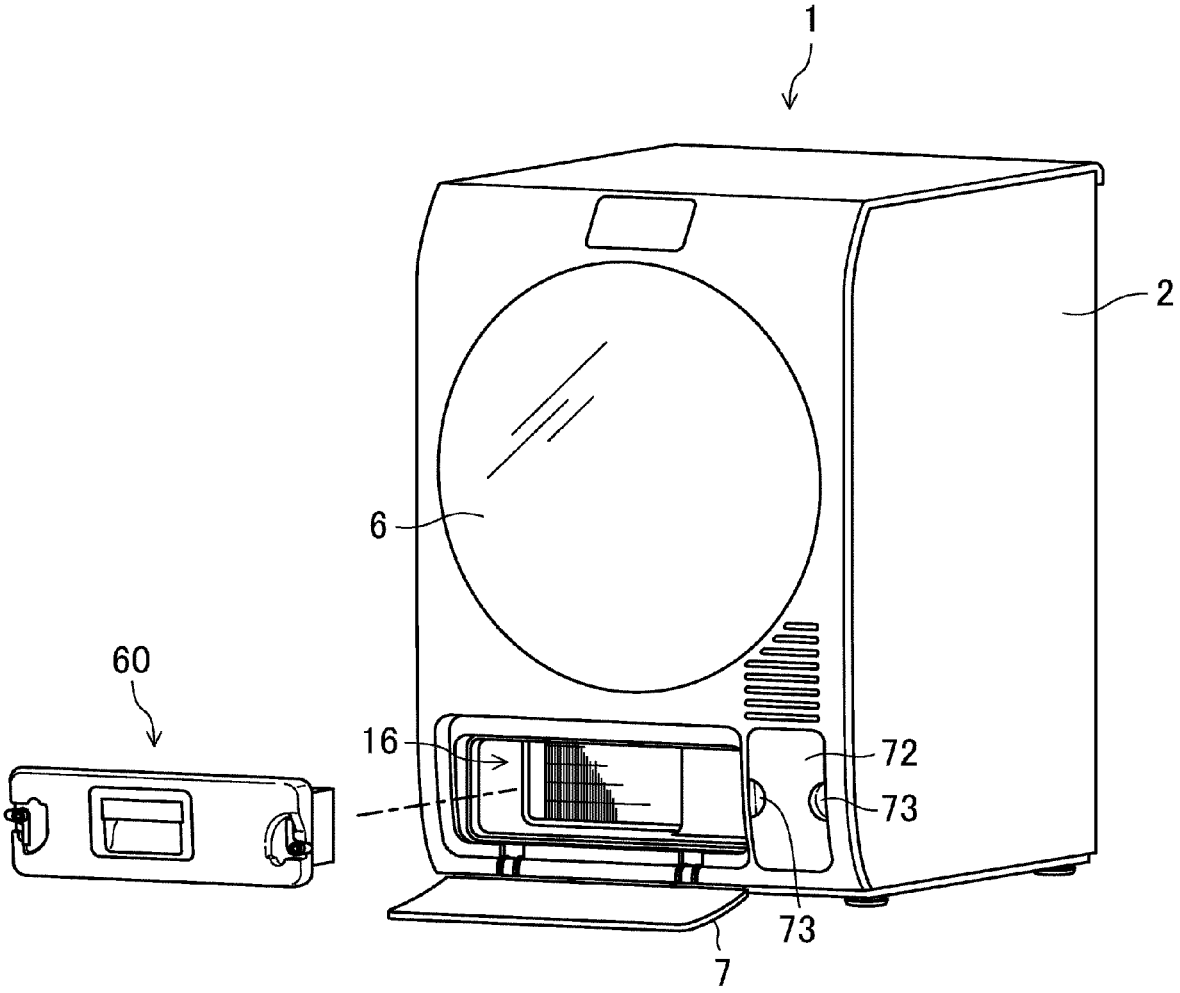
FIG. 9 is a schematic perspective view illustrating a process of attaching and detaching a lint case.

As illustrated in FIGS. 1 and 9, gripping portions 73 are installed on the left and right sides of the front wall portion 72 of the lint box 70, respectively. A user may separate the lint box 70 from the case 2 by pulling the gripping portion 73 to a front side in a state of gripping the gripping portion 73.

As illustrated in FIGS. 1 and 9, a portion of the front wall portion 72 is provided transparently, so that the user may check how much lint is accumulated in the lint box 70 without separating the lint box 70 from the case 2.

Because it may be appropriate that the front wall portion 72 of the lint box 70 does not have a transparent portion from the viewpoint of design, a transparent portion is not necessarily formed on the front wall portion 72 of the lint box 70.

(Lint Case)

Figure 10:
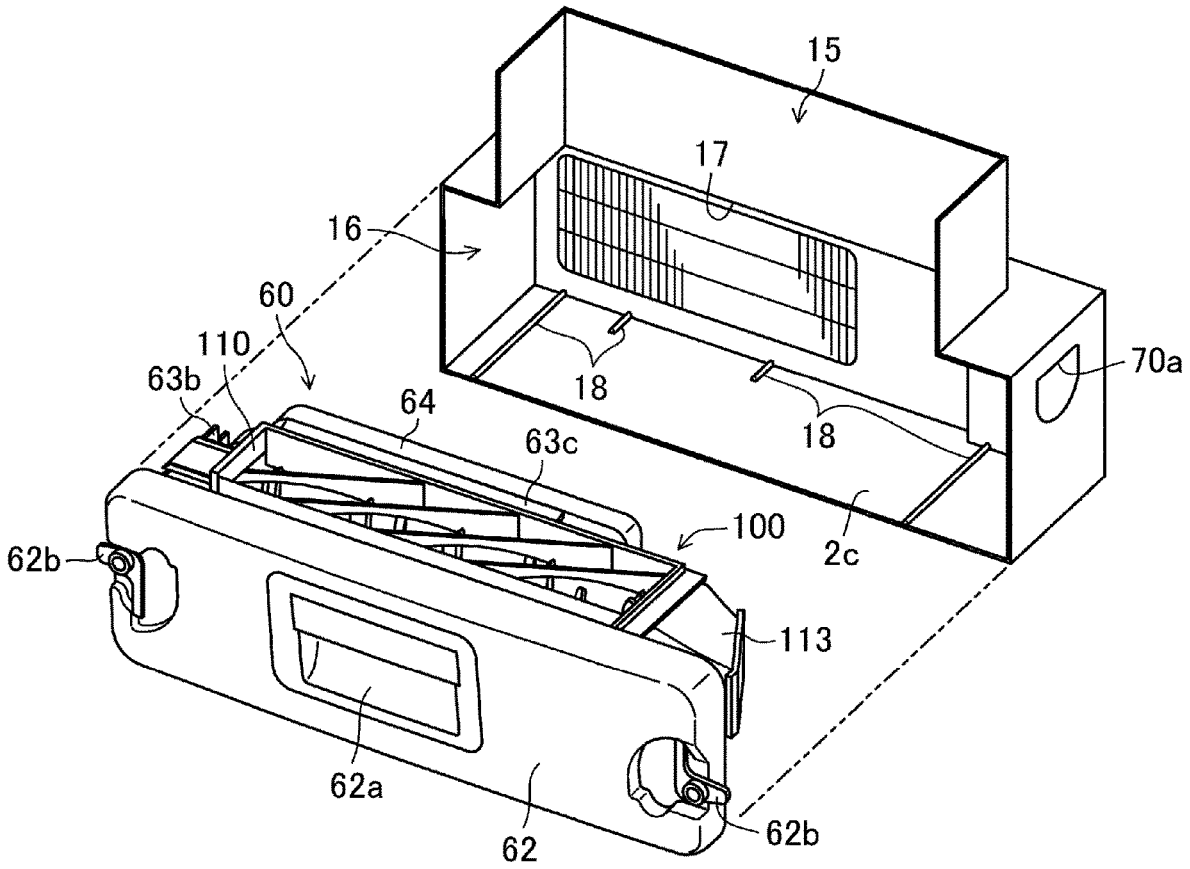
FIG. 10 is a schematic perspective view illustrating a process of mounting the lint case to a case.

As illustrated in FIG. 10, the clothes dryer 1 is provided with the detachable lint case 60. The lint case 60 may be drawn out from or put into the case 2 after the cover 7 rotatably coupled to a lower front side of the case 2 is opened.

Figure 11:
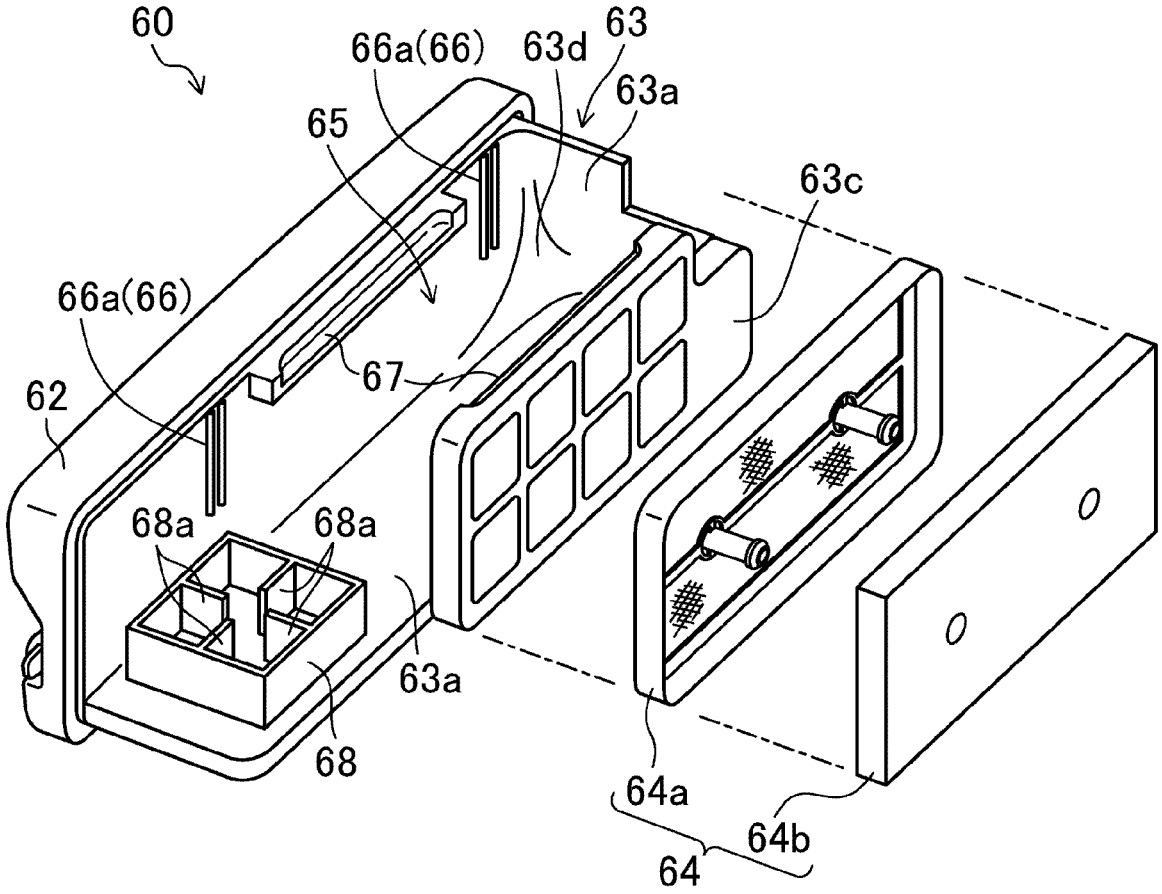
FIG. 11 is a schematic perspective view illustrating a structure of the lint case.

As illustrated in FIGS. 11 and 12, the lint case 60 integrally includes a front wall portion 62, a support frame 63, a secondary filter 64 (second filter), and the like and is coupled to the box-shaped space 16.

The lint removal device 100 is detachably mounted between the front wall portion 62 and the secondary filter 64. Therefore, the lint removal device 100 is disposed detachably in the case 2 through the lint case 60.

The front wall portion 62 constitutes a front surface of the lint case 60 and is a rectangular shaped support member formed to be transversely elongated.

A gripping portion 62*a* is formed in the center of a front surface of the front wall portion 62 to facilitate the withdrawal or insertion of the lint case 60.

A pair of stoppers 62*b* for fixing the lint case 60 to a predetermined position of the box-shaped space 16 are installed at opposite ends of the front surface of the front wall portion 62. By the pair of stoppers 62*b*, the front wall portion 62 may be mounted in the case 2 with the front surface thereof facing forward.

The support frame 63 is composed of a rectangular shaped lower wall portion 63*a* formed to be transversely elongated, a right wall portion 63*b*, a filter support portion 63*c*, and the like.

The lower wall portion 63*a* protrudes rearward from a lower edge of the front wall portion 62. The right wall portion 63*b* is connected to a right edge of the lower wall portion 63*a* and protrudes rearward from a right end edge of the front wall portion 62. The filter support portion 63*c* protrudes upward from a rear edge of the lower wall portion 63*a*. A right end of the filter support portion 63*c* is connected to a rear edge of the right wall portion 63*b*.

At boundary portions where the front wall portion 62, the lower wall portion 63*a*, the right wall portion 63*b*, and the filter support portion 63*c* abut, an arc-shaped curved portion 63*d* extending along these boundary portions is formed.

The secondary filter 64 is a filter for collecting lint passed through the lint filter 130 of the lint removal device 100.

The secondary filter 64 includes a frame member 64*a* having a mesh-shaped filter covering the air inlet 17 and provided in a transversely elongated rectangular shape, and a secondary filter body 64*b* inserted into and fixed to the frame member 64*a*.

The frame member 64*a* is supported on the filter support portion 63*c* to face the front wall portion 62 in a state of being spaced apart in the front-rear direction. The secondary filter body 64*b* may be formed of a porous sponge filter or the like having a high collecting performance.

The frame member 64*a* is integrated with the lint case 60 by being screwed to the filter support portion 63*c*. Because the secondary filter body 64*b* is inserted into and fixed to the frame member 64*a*, the secondary filter body 64*b* may be separated from the lint case 60. Therefore, the cleaning work of the secondary filter main body 64*b* may be easily performed, and the workability is excellent.

As illustrated in FIG. 11, an area between the front wall portion 62 of the lint case 60 and the filter support portion 63*c* is provided as an accommodating space 65 for accommodating the lint removal device 100.

In order the lint removal device 100 may be accommodated smoothly in the accommodating space 65, a guide portion 66, which guides the lint removal device 100 when the lint removal device 100 is attached to the lint case 60, is provided on the front wall portion 62 and the filter support portion 63*c*. Specifically, front grooves 66*a* extending in the up-down direction are formed at a position spaced from a right end to the left side and a position spaced from a left end to the right side on the front wall portion 62, respectively, and a rear groove 66*b* is formed at a position on the filter support portion 63*c* corresponding to the front groove 66*a* positioned at the right side of the front wall portion 62.

Front projections 114 extending in the up-down direction and protruding toward the front side are formed at right and left ends of a front portion of the lint processing portion 112, respectively, and a rear projection (not shown) extending in the up-down direction and protruding toward the front side is formed at a right end of a rear portion of the lint processing portion 112.

When the lint removal device 100 is mounted on the lint case 60, in order that the front protrusions 114 on the left and right sides of the lint processing portion 112 are inserted into the front grooves 66*a* on the left and right sides of the front wall portion 62, respectively, and at the same time, the rear projection (not shown) of the lint processing portion 112 may be inserted into the rear groove 66*b* of the filter support portion 63*c*, the lint removal device 100 is moved from an upper side of the accommodating space 65 toward the accommodating space 65. Therefore, the lint removal device 100 can be smoothly positioned at a correct position in the accommodating space 65.

Figure 14:
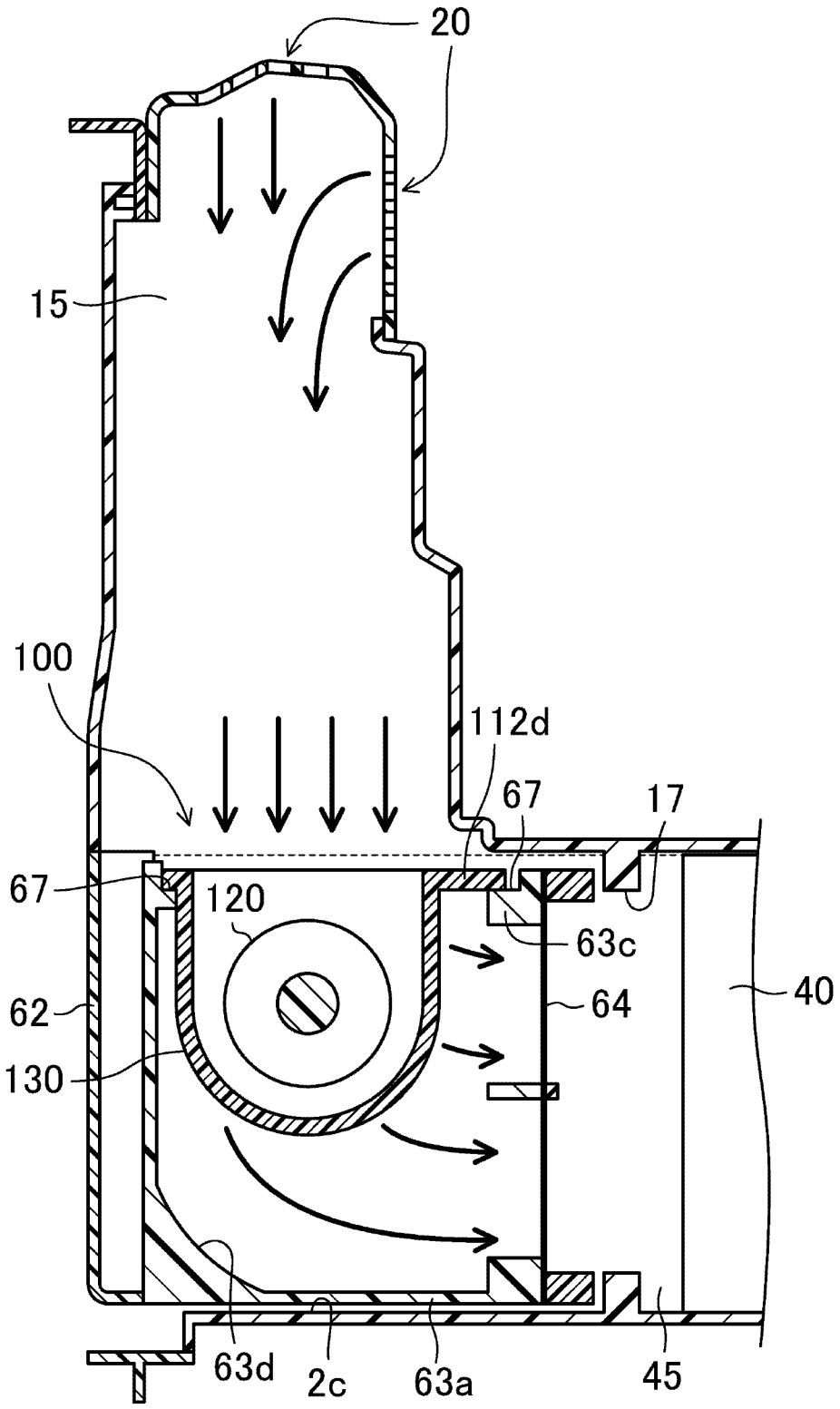
FIG. 14 is a cross-sectional view taken along line XIV-XIV in FIG. 13.

As illustrated in FIGS. 12 and 14, the lint case 60 is provided with an upper support portion 67 and a lower support portion 68 for supporting the lint removal device 100 in a state in which the lint removal device 100 is accommodated in the accommodating space 65.

The upper support portion 67 of a front side protrudes rearward from an inner surface of an upper portion of the front wall portion 62 (see FIG. 11). The upper support portion 67 of a rear side is formed in a concave shape at an edge of an upper end of the filter support portion 63*c* of the support frame 63.

The protrusion portion 112*d* of the lint processing portion 112 is coupled to the upper support portion 67 in the state in which the lint removal device 100 is accommodated in the accommodating space 65.

The lower support portion 68 is formed at a left end of the lower wall portion 63*a* of the support frame 63. The lower support portion 68 is formed in a thin box shape with an open upper side.

As illustrated in FIGS. 8 and 11, a plurality of (four in this embodiment) wing-shaped portions 68*a* extending toward the center of the lower support portion 68 is formed on the lower support portion 68, and the protrusion portion 113*a* of the lint induction portion 113 of the lint removal device 100 is coupled to an upper end of the wing-shaped portion 68*a*.

The protrusion portion 113*a* is coupled to the upper end of the wing-shaped portion 68*a* in the state in which the lint removal device 100 is accommodated in the accommodating space 65.

As the lint removal device 100 is supported in a state in which the protrusion portion 113*a* is fitted to the wing-shaped portion 68*a*, as illustrated in FIG. 8, the lint removal device 100 in a state of being mounted on the lint case 60 is disposed in a state of being spaced upward from the lower wall portion 63*a* of the support frame 63 and spaced upward from the bottom surface 2*c* of the case 2.

In the state in which the lint removal device 100 is mounted on the lint case 60, the lint case 60 is fitted into the box-shaped space 16 with the front wall portion 62 of the lint case 60 facing forward, and disposed at a predetermined position of the case 2.

As illustrated in FIG. 10, a plurality of ribs 18 extending in a front-rear direction is formed on a bottom surface of a portion where the lint case 60 is disposed inside the case 2, that is, on the bottom surface 2*c* (strictly the bottom surface of the wall unit 10) of the case 2 constituting the box-shaped space 16. The lint case 60 may be fitted into the box-shaped space 16 in a state where the lower wall portion 63*a* of the support frame 63 is mounted on the plurality of ribs 18. That is, the lower wall portion 18 of the lint case 60 is mounted on the plurality of ribs 18.

Because a contact area between the bottom surface 2*c* of the case 2 and the lower wall portion 63*a* of the lint case 60 is reduced by the plurality of ribs 18, when the lint case 60 is separated from the case 2 and when the lint case 60 is mounted on the case 2, a sliding resistance between the bottom surface 2*c* of the case 2 and the lower wall portion 63*a* of the lint case 60 may be reduced. Therefore, the lint case 60 may be easily separated from the case 2, the lint case 60 may be easily mounted on the case 2, and maintenance and repair performance of the lint case 60 may be improved.

As illustrated in FIGS. 8 and 14, the lint removal device 100 is disposed inside the box-shaped space 16, that is, at a portion of the exhaust duct 45 where the exhaust duct 45 communicates with the connecting duct 15, in a state where the lint filter 130 is spaced apart from the bottom surface 2*c* of the case 2.

As illustrated in FIG. 14, the lint removal device 100 is disposed such that the whole thereof is positioned below an upper end of the heat exchanger 40.

As illustrated in FIG. 14, when the lint case 60 is mounted in the predetermined position of the case 2, the secondary filter 64 is located in a portion upstream of the heat exchanger 40 inside the exhaust duct 45 and disposed in close contact with a front surface of the air inlet 17 that is open toward the front.

When the lint case 60 is mounted in the predetermined position of the case 2, an opening of the lint induction portion 113 and the lint transfer port 61*a* are connected to each other.

In the first embodiment, when the lint case 60 is mounted in the predetermined position of the case 2, the lint removal device 100 is not directly supported on the case 2, and like the lint removal device 100, the secondary filter 64 is not directly supported on the case 2 as well.

As such, because the lint removal device 100 and the secondary filter 64 are not directly supported on the case 2 when the lint case 60 is mounted in the predetermined position of the case 2, when the lint case 60 is separated from the case 2, the lint removal device 100 and the secondary filter 64 are also separated from the case 2 together with the lint case 60. Accordingly, because the lint removal device 100 and the secondary filter 64 are separated from the case 2 together with the lint case 60 when the lint case 60 is separated from the case 2 to maintain or repair the lint removal device 100 or the secondary filter 64, maintenance and repair may be performed smoothly.

The air inlet 17 is located at an inner side of the box-shaped space 16 and thus is positioned at a rear side and further inclined than the lint filter 130.

Figure 13:
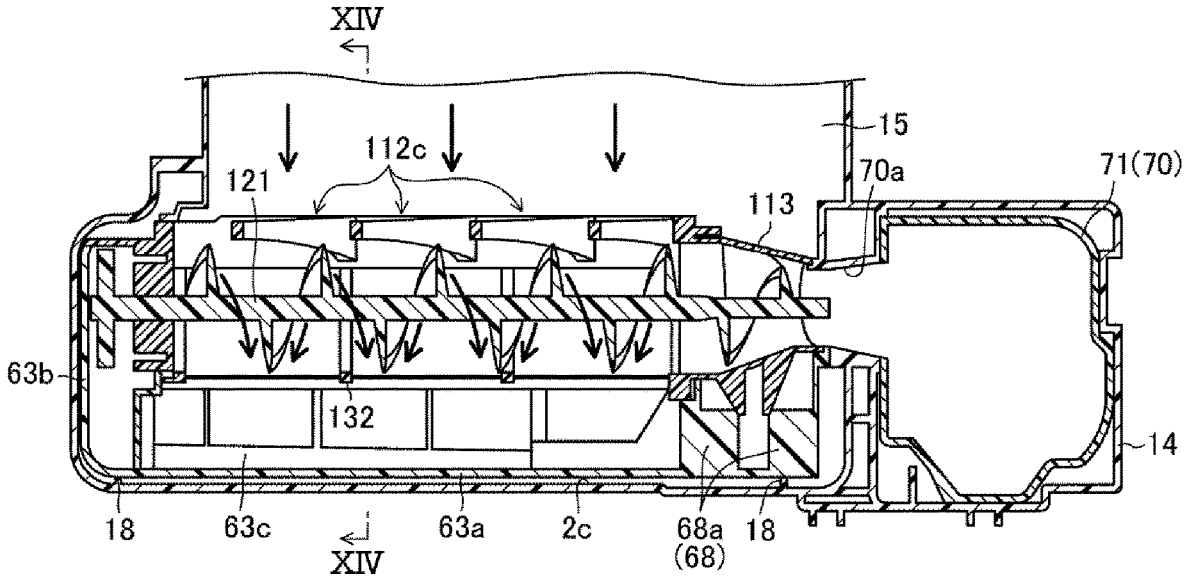
FIG. 13 is a schematic view for explaining the flow of air flowing out of a drum.

As illustrated in FIG. 13, the transversely elongated lint removal device 100 is positioned close to an inclined lower side of the right side of the transversely elongated exhaust port 20 through the transversely elongated connecting duct 15. The transversely elongated air inlet 17 is located close to the rear side of the lint removal device 100. The evaporator 41 is located close to the rear of the air inlet 17.

In the first embodiment, the lint removal device 100 is disposed in the exhaust duct 45 having a larger flow path cross-sectional area than the connecting duct 15 rather than the connecting duct 15. Accordingly, the air flowing out of the drum 30 forms a band-shaped flow having a large transverse width, and is guided into the exhaust duct 45 with almost no change in a cross-sectional area of airflow to reach the heat exchanger 40. Therefore, the pressure loss of air due to the lint removal device 100 may be reduced, and a smooth circulation airflow may be formed with a low load.

Especially, in the first embodiment, the lint removal device 100 is disposed in the box-shaped space 16 communicating with the connecting duct 15 inside the exhaust duct 45. Because the box-shaped space 16 has a large flow path cross-sectional area in the entire exhaust duct 45, the pressure loss of air caused by the lint removal device 100 may be more effectively reduced.

Because the lint filter 130 is disposed in a state of being spaced apart from the bottom surface 2*c* of the case 2, air flowing through the exhaust duct 45 may exit the entire lint filter 130.

In addition, because the lint filter 130 is provided in an elongated cylindrical shape, the lint filter 130 may have a sufficiently large filtration area.

Because air with little disturbance is uniformly distributed throughout the lint filter 130 by the screw 120, lint may be collected evenly throughout the lint filter 130. Therefore, because clogging does not occur even when a large amount of lint is generated, so that the pressure loss of air due to the lint removal device 100 may be more effectively reduced.

The air flowing along an inner side of the screw 120 among air flowing through the lint removal device 100 is rectified in a flow toward a lower side of a right slope by the inclination of the fin 122. Therefore, air may be smoothly induced to the secondary filter 64 and the air inlet 17 positioned at the lower side of a right inclination of the lint removal device 100.

The air flowing in the front of the screw 120 is rectified in a direction opposite to the air inlet 17, that is, from the exhaust port 20 toward a lower side of a left inclination, by the inclination of the fin 122. In the first embodiment, because the lint removal device 100 is disposed in a state of being spaced apart from the lower wall portion 63*a* of the lint case 60 in the box-shaped space 16, air exits the lint filter 130 of the lint removal device 100 toward the lower side of the left inclination, and then reaches a relatively wide space formed on the lower side of the lint removal device 100. Because there are almost no obstacles in the space, the air that has reached the space flows toward the secondary filter 64 and the air inlet 17 by the action of the blowing device 50.

Though a part of the air exiting the lint filter 130 of the lint removal device 100 is deflected rearward, because the curved portion 63*d* is formed on the support frame 63 of the lint case 60 disposed in the box-shaped space 16, air introduced into the box-shaped space 16 from the connecting duct 15 may be more smoothly induced to the secondary filter 64 side.

In the first embodiment, the lint removal device 100 is mounted on the lint case 60 such that the lint removal device 100 is located in the box-shaped space 16 when the lint case 60 is mounted in the case 2 and the lint removal device 100 is separated from the case 2 together with the lint case 60 when the lint case 60 is separated from the case 2. Therefore, attachment and detachment of the lint removal device 100 is easy, and the maintenance and repair performance is improved.

Because attachment and detachment of the lint removal device 100 is easy, the maintenance and repair performance of the lint removal device 100 may be improved, and the lint removal function by the lint removal device 100 may be maintained in a high level. Therefore, the pressure loss of air caused by the accumulation of lint in the lint removal device 100 may be reduced, and the pressure loss of air due to the lint removal device 100 may be reduced more effectively.

In the first embodiment, the lint removal device 100 is mounted to be spaced apart from the lower wall portion 63*a*, between the front wall portion 62 and the filter support portion 63*c* in the front-rear direction. Therefore, the lint case 60, the lint removal device 100 and the secondary filter 64 may be compactly disposed.

In maintenance and repair, in a state where the lint removal device 100 and the secondary filter 64 mounted on the lint case 60, the lint case 60 may be easily separated from the case 2 and may be easily mounted in the case 2.

In the first embodiment, when the lint removal device 100 is mounted between the front wall portion 62 and the filter support portion 63*c*, the guide portion 66 guiding the lint removal device 100 is installed on the front wall portion 62 and the filter support portion 63*c*. Therefore, the maintenance and repair performance is further improved. That is, in order to easily maintain and repair the lint removal device 100, it is appropriate to separate the lint removal device 100 from the lint case 60, and after maintenance and repair, it is required to attach the lint removal device 100 to the lint case 60 again. Therefore, when the lint removal device 100 is mounted, in a case where the guide portion 66 for guiding the lint removal device 100 is installed, the lint removal device 100 may be accurately and easily mounted at a desired position, and the maintenance and repair performance is further improved.

In the first embodiment, the lattice 112*b* is installed on the lint processing portion 112 of the frame member 110. Therefore, the lint film can be appropriately transferred to the lint box 70. That is, when the lint film is scraped from the lint filter 130 by rotating the screw 120, the lint film scraped along the fin 122 of the screw 120 may move upward. When the lint processing portion 112 is provided on the lattice 112*b*, the upward movement of the lint film may be prevented by the lattice 112*b*.

Therefore, in the first embodiment, because the lint removal device 100 is disposed in the exhaust duct 45, the pressure loss of air due to the lint removal device 100 is reduced, and the maintenance and repair performance is improved.

<Second Embodiment>

Hereinafter, a second embodiment of the present disclosure will be described in detail with reference to the drawings. In the following description, the same reference numerals are given to parts common to the first embodiment, and detailed description thereof will be omitted.

Figure 15:
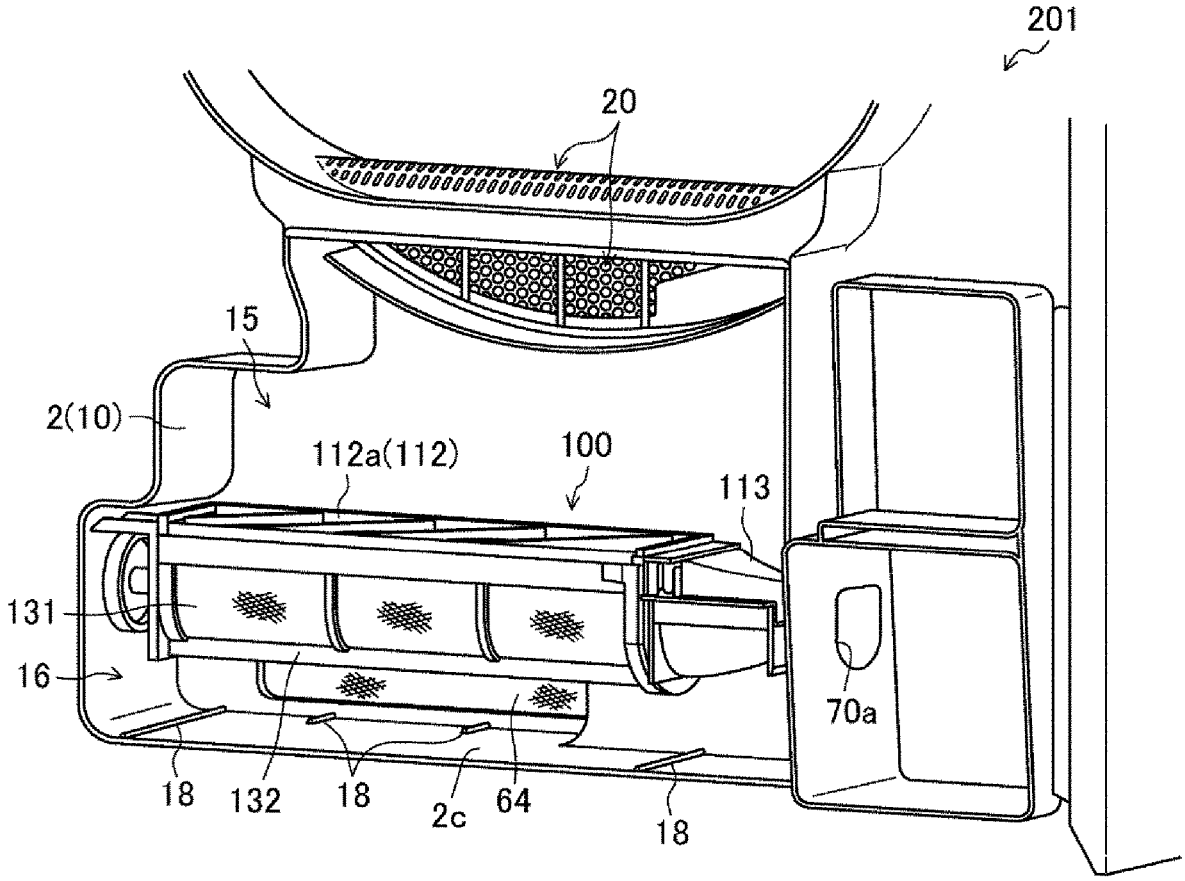
FIG. 15 is a schematic perspective view illustrating the periphery of a lint removal device in a clothes dryer of a second embodiment of the present disclosure.

FIG. 15 illustrates the periphery of the lint removal device 100 in a clothes dryer 201 of a second embodiment of the present disclosure.

The second embodiment differs from the first embodiment in that the lint removal device 100 is not mounted on the lint case 60 but directly mounted on the case 2 (strictly the wall unit 10).

The second embodiment, like the lint removal device 100, the secondary filter 64 is not attached to the lint case 60, but is directly attached to the case 2.

As illustrated in FIG. 15, the lint removal device 100 is disposed in an exhaust duct 45, more specifically, in a portion of the exhaust duct 45 that communicates with the connecting duct 15 (the box-shaped space 16 in FIG. 15), in a state of being spaced apart from the bottom surface 2*c* of the case 2. Therefore, as in the first embodiment, the pressure loss of air due to the lint removal device 100 may be reduced.

The lint removal device 100 may be fixed to the case 2 or provided detachably in the case 2.

The structure for supporting the lint removal device 100 inside the case 2 is not limited as long as the lint removal device 100 may be disposed in the box-shaped space 16 in a state of being spaced apart from the bottom surface 2*c* of the case 2.

For example, a structure in which the lint removal device 100 is supported by the case 2 by forming a protrusion portion toward the left side from a left end of the frame body 112*a* of the lint processing portion 112 of the lint removal device 100, forming a protrusion portion toward the right side from a right end of the frame body 112*a*, forming fitting grooves, into which the protrusion portions are fitted, in side wall portions on the left and right sides of the case 2, and fitting the protrusion portions of the lint processing portion 112 into the fitting grooves of the side wall portions of the case 2 is also possible.

(Other Embodiments)

The present disclosure is not limited to the above embodiments, and may be modified without departing from the gist of the claims.

For example, in the above-described first and second embodiments, the lint removal device 100 is disposed in a portion in the exhaust duct 45 communicating with the connecting duct 15, but the present disclosure is not limited thereto, and as long as it is located upstream of the heat exchanger 40 inside the exhaust duct 45, the lint removal device 100 may be disposed at a location other than the portion communicating with the connecting duct 15.

In the first and second embodiments, the exhaust duct 45 forms a substantially L-shaped flow path together with the connecting duct 15 when viewed in the left-right direction, but the exhaust duct 45 and the connecting duct 15 may not form an substantially L shape.

In the first and second embodiments, the lint box 70 is configured separately from the lint case 60, but the present disclosure is not limited thereto, and the lint box 70 may be integrally configured with the lint case 60. In this case, the front wall portion 62 of the lint case 60 is formed entirely along a width direction of the front wall portion (the front wall portion of the wall unit 10) of the case 2.

In the first and second embodiments, the lint film is transferred from the right side toward the left side in the lint removal device 100 and is introduced into the lint box 70 installed on the left side, but the present disclosure is not limited thereto, and in a case where a space may be secured on the right side of the air inlet 17, the lint box 70 may be disposed on the right side of the air inlet 17, and the lint removal device 100 is configured such that the lint film is transferred from the left side toward the right side.

In the first and second embodiments, the plurality of ribs 18 is formed on the bottom surface 2*c* of the case 2, but the present disclosure is not limited thereto, and instead of the ribs being formed on the bottom surface 2*c* of the case 2, a structure in which a plurality of ribs is formed on a lower surface of the lower wall portion 63*a* of the lint case 60 is also possible. Even in this structure, because a contact area between the bottom surface 2*c* of the case 2 and the lower wall portion 63*a* of the lint case 60 is small, a sliding resistance between the bottom surface 2*c* of the case 2 and the lower wall portion 63*a* of the lint case 60 may be reduced.

While the present disclosure has been particularly described with reference to exemplary embodiments, it should be understood by those of skilled in the art that various changes in form and details may be made without departing from the spirit and scope of the present disclosure.

The invention claimed is:

1. A dryer comprising:

a case;

a drum rotatably supported inside the case;

an air supply port configured to guide air into the drum;

an exhaust port configured to guide air inside the drum to an outside of the drum;

an exhaust duct configured to guide air passed through the exhaust port to the air supply port;

a connecting duct connecting the exhaust port and the exhaust duct;

a heat exchanger disposed inside the exhaust duct and configured to exchange heat with air flowing in the exhaust duct;

a lint removal device configured to remove lint in the air passed through the exhaust port and including a first filter configured to collect lint in the air that passes through exhaust port; and a lint case configured to receive the lint removal device and detachably mounted to the case and configured such that at least a portion thereof is disposed inside the exhaust duct when the lint case is mounted in the case, wherein the lint removal device is detachably mounted to the lint case, wherein the lint case comprises:

a second filter disposed in a rear of the first filter when the lint removal device is mounted, and a front wall portion and a support frame coupled to the rear of the front wall portion, wherein the support frame comprises:

a lower wall portion extending rearward from an inner surface of the front wall portion, and a filter support portion extending upward from an edge of the lower wall portion to support the second filter, wherein the lint removal device is disposed inside the exhaust duct and configured to communicate with the connecting duct, wherein the front wall portion comprises at least one guide portion configured to guide the lint removal device when the lint removal device is mounted to the lint case, and the guide portion protrudes from the inner surface of the front wall portion.

2. The dryer according to claim 1, wherein the lint removal device comprises:

a frame member having at least one hole communicating with the connecting duct, wherein the first filter is mounted on the frame member to collect lint in the air passed through the exhaust port; and a lint transfer body configured to transfer the lint collected in the first filter to one side of the frame member.

3. The dryer according to claim 2, wherein the first filter is detachably mounted to the frame member.

4. The dryer according to claim 2, wherein the lint removal device is disposed such that the first filter is spaced apart from a bottom surface of the case.

5. The dryer according to claim 1, wherein:

the connecting duct is configured such that air passed through the exhaust port therefrom flows downward toward the exhaust duct, and the exhaust duct is formed to be elongated in a front-rear direction such that air passed through the connecting duct therefrom flows from a front of the drum to a rear of the drum.

6. The dryer according to claim 1, wherein the exhaust duct is disposed below the connecting duct.

7. The dryer according to claim 1, wherein the heat exchanger is disposed downstream of the lint removal device along a direction in which the air flows in the exhaust duct.

8. The dryer according to claim 1, wherein the lint removal device is detachably mounted to the exhaust duct.

9. The dryer according to claim 1, wherein the second filter is disposed in a front of the heat exchanger in the exhaust duct.

10. The dryer according to claim 1, wherein the lint case is accommodated between the front wall portion and the filter support portion when the lint removal device is mounted.

11. The dryer according to claim 1, wherein a bottom surface of the case comprises at least one support rib configured to support the lower wall portion when the lint case is mounted in the case.

12. The dryer according to claim 1, wherein:

the exhaust duct comprises an accommodating space configured to accommodate the lint removal device, and a width of the accommodating space in a left-right direction of the case is formed larger than a width of the connecting duct.

13. The dryer according to claim 1, further comprising a support frame having an entrance allowing clothes to be put in and out and coupled to an inner surface of the case, wherein the connecting duct is formed in the support frame.

* * * * *